United States Patent [19]

Creager

[11] Patent Number: 4,783,935

[45] Date of Patent: Nov. 15, 1988

[54] MONOLITHIC FOUNDATION SYSTEM FOR BUILDINGS AND FORM THEREFOR

[76] Inventor: William B. Creager, 5410 W. Barbara Ave., Glendale, Ariz. 85302

[21] Appl. No.: 894,219

[22] Filed: Aug. 6, 1986

[51] Int. Cl.[4] ..... E04B 1/16

[52] U.S. Cl. ..... 52/98; 52/295; 52/743; 264/31; 405/243; 405/257

[58] Field of Search ..... 52/295, 127.2, 127.3, 52/127.4, 292, 294, 743, 98; 264/31, 34; 405/243, 251, 257

[56] References Cited

U.S. PATENT DOCUMENTS

| | | | |
|---|---|---|---|
| 1,378,351 | 5/1921 | Hoyle | 52/295 |
| 2,978,779 | 4/1961 | Tatsch | 52/127.2 |
| 3,205,634 | 9/1965 | Wagner | 52/127.3 |
| 3,422,585 | 1/1969 | Dismukes | 52/127.3 |
| 3,762,678 | 10/1973 | Thornton | 249/193 |
| 3,767,158 | 10/1973 | Mikus | 249/192 |
| 3,869,836 | 3/1975 | Allen | 52/295 |
| 4,107,889 | 8/1978 | Crooks | 52/259 |
| 4,186,160 | 1/1980 | Landreth | 52/293 |
| 4,275,538 | 6/1981 | Bounds | 52/294 |

FOREIGN PATENT DOCUMENTS

| | | | |
|---|---|---|---|
| 6552 | 3/1927 | Australia | 52/127.2 |

*Primary Examiner*—David A. Scherbel
*Assistant Examiner*—Caroline D. Dennison
*Attorney, Agent, or Firm*—Harry M. Weiss & Associates

[57] ABSTRACT

This invention relates to a method of constructing a footing and a foundation wall thereon, and form therefore in a hardenable building material for use in a continuous, perimeter type building foundation. An improved shape for the footing and foundation wall is disclosed which allows the use of a novel formwork system, thus permitting both elements to be cast simultaneously in a monolithic arrangement. Additionally, the cast shape of the foundation system is such that the basic function of transmitting superimposed building loads to the earth is an improvement over the more traditional types of foundation systems. In the preferred embodiment of the invention, much of the formwork is expendable and is permanently left in place, being removed only where visable in the finished structure.

39 Claims, 6 Drawing Sheets

MONOLITHIC FOUNDATION SYSTEM FOR BUILDINGS AND FORM THEREFOR

BACKGROUND OF THE INVENTION

The present invention is applicable to the formation of a continuous, perimeter type building foundation comprising a footing cast on earth and a wall cast atop said footing, both constructed of a hardenable plastic material having strength and mechanical characteristics suitable for a building foundation. It is standard, widely accepted practice to construct such foundations of concrete using rigid forms of wood or steel to contain and shape the fluent mixture.

The art of forming building foundations using a plastic concrete mixture is well known and is traditionally accomplished in a multi-step process calling for a number of different skilled craftsmen. A trench of specified width and depth is excavated in the earth to receive a predetermined amount of fluent concrete, which is placed in the trench to a specific depth to form a footing therein of generally a rectangular shape.

Once the footing concrete has hardened, concrete wall forms comprising opposing, parallel, vertical units are constructed on the top surface of said footing using elongate panels, such as sheets of plywood. These forms define the general shape of an elongate foundation wall of predetermined height, width and length on top of the footing. These vertical wall forms are connected in edge to edge fashion and secured to each other, strengthened and braced by additional structural members, and supported by various means on the footing to resist the horizontal forces generated by the fluent concrete mixture.

A second predetermined amount of fluent concrete material is placed between these parallel, elongate panels so as to form a foundation wall therein. Thereafter, the forms are removed from the surface of the hardened concrete foundation wall, and fill material is placed back on top of the footing and next to the walls, completely covering said footing underground and thereby completing the structural foundation construction process.

The wall forms used in this manner are then cleaned, repaired if necessary, oiled (a type of release agent to assist in breaking the chemical bond between the wood and the concrete), removed from the site and transported to the next project, or stored for future use.

The concrete footing and foundation wall thus constructed is generally reinforced with deformed steel rebar, and embedments such as anchor bolts, rebar dowels, metal straps and other attachments are cast into the concrete elements to connect the superstructure above to the foundation system below.

Although several variations of constructing concrete foundations by the above described method exist, the most commonly used procedure is to attach and anchor the foundation wall formwork to the top of the previously placed, hardened concrete footing through the use of metal attachments called form ties.

Generally, form ties are elongate metal straps one or two inches wide, having a short flange extending from each end in a perpendicular fashion to the main portion of the strap, each flange being separated by a predetermined distance from the opposing flange so as to contain and separate the form sidewalls within according to a predetermined wall width. The form ties are commonly attached "flanges up" on the top of the footing so as to restrain, via the upturned flanges, the wall forms between them at a predetermined separation. The form ties are commonly attached "flanges down" to the top of the wall forms, thereby restraining these forms at the top in a similar manner.

Many other types of ties have been used successfully (threaded rods, steel bars and straps, and the like), however, the basic function has remained the same: Hold the opposing, parallel wall forms on the top of the footing together by resisting the outward forces created by the hydrostatic force on the form from the fluent concrete.

Several drawbacks are evident in implementing the above foundation construction process and form support methods, First, the traditional construction process dictates that before the foundation wall can be constructed, the footing below must be placed and allowed to harden. The waiting period required between the construction activities in this process results in additional mobilization of personnel and material, and adds to the length of the construction time. Both of these inherent characteristics of the traditional process significantly increase the overall cost of the foundation system.

Second, the removal, cleaning, oiling, repair, handling, transporting, and storing of the foundation wall forms is a very labor intensive process, requiring significant investments in both time and material. This formwork activity is a major expense item for concrete construction.

Third, the entire traditional process normally requires construction to be accomplished in numerous phases by skilled craftsmen over the span of several days, placing additional economical restraints on the procedure.

Fourth, casting the foundation wall atop the footing after the footing hardens results in a "cold joint," or "weak seam," between the two elements at their intersection. This causes a reduction of structural interaction between the two elements and provides a convenient path for water or moisture to migrate under the structure and floor slabs.

Fifth, a large number of form ties are required to anchor and support the wall forms. Since some of these are left permanently cast in the concrete (typically the bottom ties, occasionally the top ties), a continuing investment in new material is required. Also, the permanently cast bottom tie forms an additional path for moisture penetration through the foundation wall, especially if it becomes corrodded.

Certain prior art in the field of constructing foundations with formed concrete have attempted to address some of the inherent disadvantages of the present technology.

U.S. Pat. No. 4,186,160 discloses a method of forming foundation walls atop the hardened footing that eliminates the use of the bottom form ties by utilizing continuous slots formed in the top of the footing while still plastic within which the plywood wall forms are engaged and supported after the footing concrete hardens. Employing this method of construction does overcome the use of many of the bottom form ties. However, several drawbacks in the present art are not addressed by the method described in the referenced patent:

(1) The footing must still be poured and hardened prior to forming the wall atop; (2) a cold joint is present in the construction; and (3) the plywood wall forms must still be removed, cleaned, oiled, handled and stored for future use.

Certain other prior art, exemplified by U.S. Pat. Nos. 3,762,678 and 3,767,158, among others, disclose improved methods of concrete forming using an ingenious array of clips, supports, braces, attachments and heavily reinforced removable forms. Some of these systems have gained acceptance and use in the construction industry, primarily in the heavy construction sector. This is due mainly to the fact that they can resist very large forces generated by mass concrete construction, and they can be quickly erected for use and dismantled for either storage or reuse on another project. However, their usefulness is diminished in the area of minor, conventional construction, since the fluent concrete pressures are typically very small, the labor intensive form breakdown process is still required, a footing must still be cast and allowed to harden prior to erecting the formwork for the casting of the wall, and these systems normally require significant investments in labor and materials.

Still other species of prior art, exemplified by U.S. Pat. Nos. 4,275,538 and 4,107,889, among others, disclose foundation systems constructed of precast concrete elements utilized in conjunction with site cast units. While these methods do offer certain economies in some situations, their use is somewhat specialized and not readily applicable to common foundation conditions. Also, the majority of the construction contractors who provide material and labor for minor, conventional foundation construction are not equipped to handle precast concrete work.

Therefore, many of the drawbacks listed above in the traditional process of constructing continuous building foundations are not sufficiently addressed by the prior art, nor the traditional methodology. What is needed, and what the present invention provides, is an efficient and economical method of forming the foundation wall atop the footing which simplies the construction process, eliminates inordinate investments in time and material, insures compliance with mandated building codes, and addresses and resolves the above noted drawbacks in the traditional process. While the disclosed process is applicable to all types of construction, it is especially applicable to minor, conventional buildings, such as residential or small commercial construction, where shallow spread footings may be used and no special foundation considerations are required.

SUMMARY OF THE INVENTION

The present invention has overcome the shortcomings of the prior art and the more traditional methods, and relates generally to improvements in the formation of a continuous building foundation comprising a footing and a foundation wall stop said footing, and is particularly directed to a structurally efficient and economical method for constructing these elements simultaneously without having to wait for the footing to harden before the wall is cast.

A unique shape and configuration of the footing and foundation wall assembly is disclosed which allows both elements to be cast simultaneously. The shape of the foundation system has been conceived to efficiently transfer all forces from the superstructure above to the supporting surface of the soil below in a manner consistent with present day building codes and accepted engineering practice. The application of the disclosed foundation configuration will be most useful for minor, conventional structures (such as residential buildings) where the required footing width is in the order of two to three times the foundation wall thickness, and the foundation wall is of limited height.

In the disclosed system, the foundation wall is a conventional, parallel faced, vertical wall extending in a horizontal direction on top of the footing. However, a small distance above the vertical elevation of the traditional footing-wall cold joint juncture, the wall begins to thicken gradually as it extends deeper. The rate of increasing thickness with depth occurs at a constant angle, typically about 60 degrees with a horizontal line, continuing in this fashion until the specified footing width is reached at the soil contact surface. Thus, the footing becomes integral to, and monolithic with, the foundation wall above, being only a "thickened" vertical extension of said wall. The wider footing can then spread superstructure forces from above to the supporting earth below.

Current building codes, widely accepted engineering practice and modern methods of construction have dictated that the footing formed by the traditional processes and the prior art include a widened portion that projects horizontally out from underneath the foundation wall above in symmetrically opposite directions, presumably to spread the vertical loads from the wall to a wider contact area of soil, thereby minimizing the resulting bearing pressure on the soil and reducing the probability of settlement.

The vertical thickness and horizontal width of this extended section of footing is normally determined through engineering analysis. In the absence of engineering design, building codes mandate minimum thickness and width requirements for this footing projection. However, building codes generally include a provision that allows any footing and foundation wall assembly to be used providing the design of the force transfer mechanism is consistent with generally accepted engineering practice.

Classical methods from engineering mechanics for analyzing the load transfer mechanism in concrete bearing structures (such as a foundation wall bearing upon a footing below) stipulate that the lines of resisting force defining the actual load carrying mass spread outward from the contact element edge on the bearing surface at an angle of between 45 and 60 degrees from the horizontal down into the supporting mass of concrete below. The concrete mass contained within and underneath these force lines is assumed to "carry" the imposed loads by internal compression and shear to the supporting soil below. The concrete mass outside of and external to these resisting force lines does not participate appreciably in this load transfer. Therefore, a significant amount of footing material in the upper triangular wedge of the footing is not utilized for load transfer in the traditional footing configuration. In fact, this "excess" material has only been provided due to the limitations of the traditional construction method, and to provide a flat work surface for building and mounting the foundation wall forms.

Classical engineering mechanics suggest that a more efficient and technically correct shape for load transfer of these forces would be to provide a shape whose contained mass follows the configuration of and is contained within these aforementioned force lines. In fact, this exact philosophy is utilized in some types of heavy concrete construction where efficient use of material must be employed for economy.

The monolithic shape of the disclosed foundation system utilizes this same approach to load transfer, thus capitalizing on the more advanced theories of concrete technology and providing a better engineered, more economical system for transferring forces to the earth.

Additionally, the monolithic nature of the foundation assembly eliminates the cold joint between the footing and the foundation wall typically found in the traditional methods of the prior art. The presence of a cold joint in foundation construction creates several problems: (1) It creates a continuous seam through the foundation system through which water or moisture can travel; (2) it causes a "weak link" in the force transfer system between the footing and the foundation wall; and (3) if it is not cleaned properly prior to casting the wall, debris, dirt or other foreign material may become embedded near the joint, further reducing the effective structural interaction between footing and foundation wall.

There is no cold joint in the disclosed monolithic construction. Furthermore, since there is no cold joint, the need for a shear key is eliminated. A shear key is a continuous depression centered under the foundation wall and extending parallel thereto that is frequently cast into the cold joint in the traditional process to help resist lateral forces and to achieve some degree of "locking," or interaction, between the footing and wall atop. The disclosed system, being monolithic in nature, overcomes all the drawbacks of the cold joint and shear key typically found in the more traditional construction process.

A new formwork system is disclosed to support the fluent foundation material in the plastic state while forming the unique shape of the footing and foundation wall atop the footing simultaneously. The lateral and buoyant support for this formwork system is obtained by utilizing the strength of the form material, the geometric properties of the foundation excavation, a new type of form tie with a ground brace, novel formwork end connectors, and the material excavated from the foundation trench itself.

In the preferred embodiment, the formwork is manufactured of a lightweight, strong material in convenient lengths so that the sections may be easily handled, rapidly attached lengthwise with special end connectors, and quickly anchored. Such materials may be laminated wood or synthetic fiber, fiber and plastic composites, or paper-like products with special coatings to retard moisture migration and provide "wet cure" conditions for the concrete. The forms may be readily cut to any length with commonly available construction equipment. Since the forms are wax or plastic coated inside and out, the resulting concrete surface is smooth and clean where the forms are removed, requiring very little, if any, finishing. The formwork furthermore has unique, pre-formed corner sections that may be used to form inside or outside corners, these sections integrating with the longer straight lengths with the use of the same special end connectors. Corner sections of 90 degrees, 45 degrees or any other angle can be readily manufactured and incorporated into the system. Additional ground braces are disclosed that provide added support for the forms to help resist lateral material handling forces. The biggest advantage, however, is that these forms are expendable, being left permanently in place under the soil and only being removed where the concrete is exposed.

The forces imposed on the formwork by the fluent foundation material in the plastic state are resisted by several methods: (1) The horizontal forces on the vertical and inclined faces of the formwork are resisted by utilizing the inherent strength characteristics of the form material, the gravity mass of the earth behind the excavation walls at the bottom inside corner of the excavation where the forms contact the soil, by the soil mass directly behind the inclined forms, and by a novel type of form tie at the top of the forms, the four acting together to stabilize the formwork, (2) vertical uplift resistance is obtained by utilizing the gravity weight of the excavated material placed back on top of the inclined form face (note that the fluent concrete material contained within the forms tries to "float" or "push" the forms upward due to the specific weight of the concrete being greater than the specific weight of the air it displaces above the inclined surface), and, if desired, the addition of small "anchors" attached to the bottom of the forms and driven horizontally into the soil, and (3) the jamming action of the footing form surface against the bottom corner of the excavation, which tries to resist both uplift forces and horizontal forces.

A novel system of formwork edge connection clips is disclosed which allows quick assembly of the formwork system while providing substantial holding power. The clips are manufactured of sheet metal, using common industry fabricating processes, and are not considered reuseable. Being manufactured of sheet metal, similar to the top ties, keeps the individual cost low and maintains overall system economy.

Two types of clips are disclosed, although other configurations may be manufactured using the same principles. One type of clip is used at the top edge of the formwork, the other at a lower level. The connection clips attach the forms in edge to edge fashion through the use of small teeth, which engage the form surface in a manner which resists removal once the clip is pushed on.

It is therefore a primary objective of the present invention to provide an improved and simplified method for constructing building foundations, especially for minor conventional structures, and thereby reduce construction costs compared with more traditional methods and the prior art.

A further objective is to provide an innovative shape of structural foundation system that, by allowing the wall and footing to be cast simultaneously and monolithically, will eliminate cold joints and shear keys between elements, and will provide numerous engineering and functional advantages over traditional foundation configurations in addition to the stated economic benefits.

A further objective in the preferred embodiment is to provide a system wherein the forms are manufactured of disposable materials, such as laminated wood or synthetic fiber, fiber and plastic composited or paper-like products, are coated with wax or plastic-like substances, and are expendable so that much of the labor and cost associated with form removal will be eliminated, or significantly reduced.

A further objective is to provide a more efficient structural path to transfer superstructure forces from above to the supporting soil below without wasting unnecessary material.

A further objective is to provide a system that can be easily installed using a minimum number of skilled craftsmen during the construction process.

A further objective is to minimize the continuing cost of heavy form ties used to separate and space the wall forms for foundation walls.

Further advantages will become readily apparent to those skilled in the art when the following description of the preferred embodiment is read and understood.

The invention of the foundation system disclosed within offers many advantages over the past and present art, and the listed advantages are of great importance to those in the construction industry who are concerned with controlling rising material and labor costs while accommodating more demanding time and schedule constraints.

DETAILED DESCRIPTION OF PREFERRED EMBODIMENTS

Figure 1:
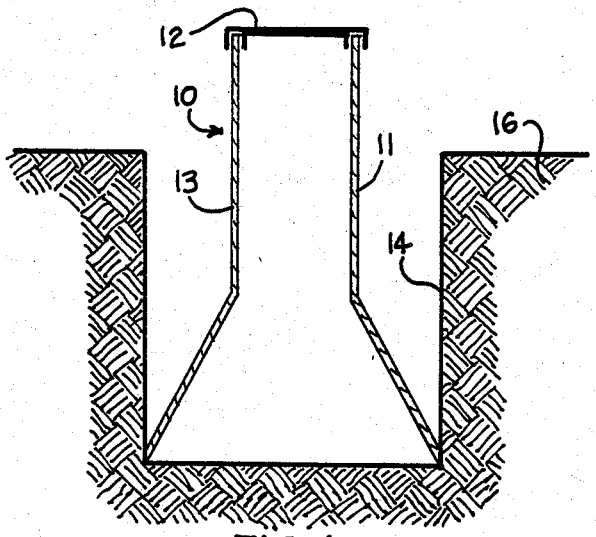
FIG. 1 is a vertical cross section view of the open earth trench for the foundation system showing a side elevational cross section of the formwork in place prior to concrete placement.

With particular reference to FIGS. 1 through 5, the preferred embodiment of the invention is set forth. The earth (natural ground or engineered compacted backfill) 16 has a horizontal trench 14 excavated therein whose width is the specified footing width to control soil bearing pressure and whose depth is the specified footing depth to the bearing surface as shown in the vertical cross section in FIG. 1. Elongate, parallel wall and footing forms 10 comprising horizontal, opposing, coplaner panels 11 and 13 connected in edge to edge fashion are supported in the bottom inside corners of the excavation 14 by application of an outward pressure against the excavation walls, and are supported at the top by form tie 12 at a specified spacing, also depicted in FIG. 1.

The exact shape and configuration of the forms 10 shall be variable, so as to allow the upper part of the foundation wall surface to be essentially vertical while the lower part enlarges symmetrical to accommodate various footing widths and foundation depths. However, the general configuration of a foundation wall providing for uniform thickening to form the footing as it extends deeper into the excavation 14 is an essential feature disclosed herein.

Figure 2:
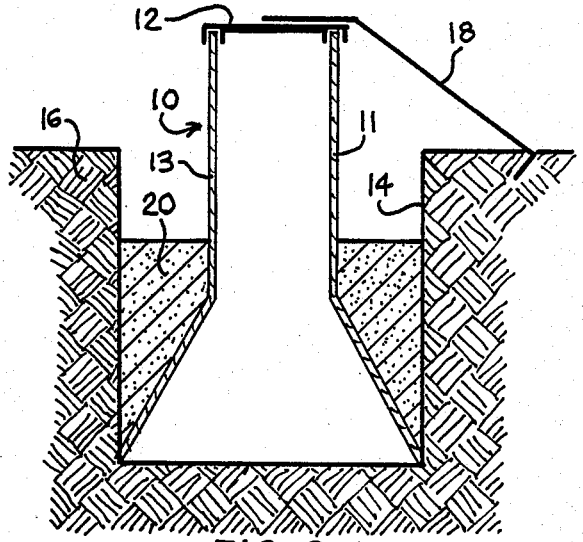
FIG. 2 is a vertical cross section view as in FIG. 1 further showing the addition of the lateral ground brace from the forms and the earth backfill on top of the inclined portion of the forms.

FIG. 2 indicates a further extension of the arrangement described in FIG. 1 in that a specified amount of soil 20 is placed into the trench 14 on top of the horizontal coplanar panels 11 and 13 of forms 10 to a specified depth and lightly compacted to provide the necessary mass to resist the horizontal and buoyant forces of the fluent concrete pressures against the forms 10. Form tie 12 at the top of the formwork provides the tension tie that supports opposing sides of the forms and resists the outward pressures induced by the fluent concrete.

Also shown in FIG. 2 is the additional form ground brace 18 spaced uniformly along the forms, and intended to laterally support the top edges of the forms 10 against overall horizontal movement during concrete placement.

Figure 3:
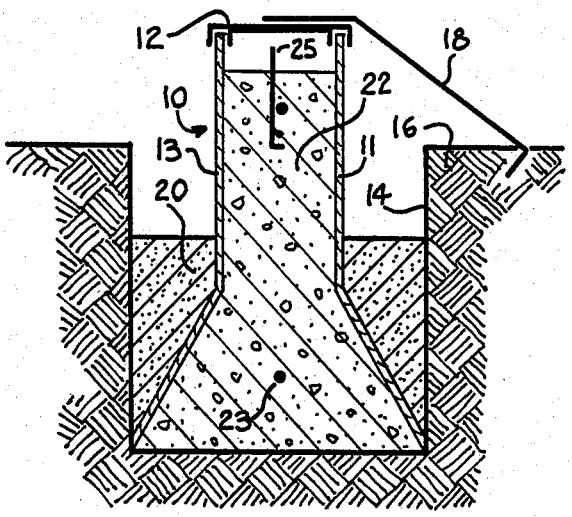
FIG. 3 is an extension of FIG. 2 showing the poured and hardened concrete material forming the foundation wall and footing system, including the reinforcing bars and superstructure attachment means.

FIG. 3 indicates the fluent concrete 22 placed within the cavity formed by the horizontal coplanar panels 11 and 13 of elongate forms 10, and the deformed steel reinforcement 23 and other steel appurtenances 25 cast within the foundation assembly. The reinforcement 23 and appurtenances 25 are placed into the fluent concrete 22 and temporarily supported by any convenient means.

Figure 4:
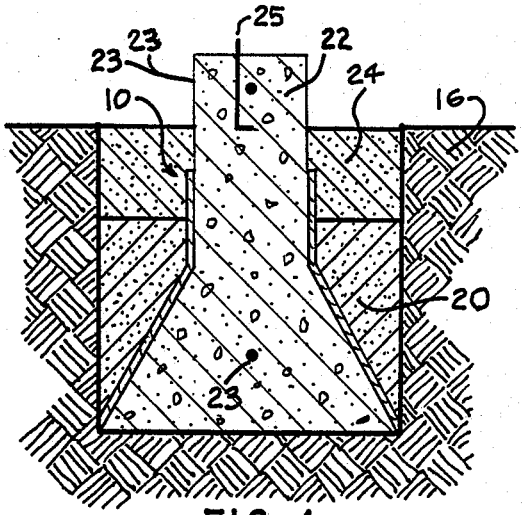
FIG. 4 is a vertical cross section view that indicates the final configuration of the foundation system with the exposed formwork stripped away leaving a bare concrete surface above ground and additional earth backfill added to level the building site.

FIG. 4 indicates the final configuration of the foundation system with the horizontal coplanar panels 11 and 13 of forms 10 partially removed near the top of the foundation wall to expose concrete surfaces 23 of concrete wall 22 as required and the remaining horizontal coplanar panels 11 and 13 of forms 10 left permanently in place below the final soil line. Additional earth backfill 24 is placed in the trench 14 on top of previously placed backfill 20 and leveled.

Figure 5:
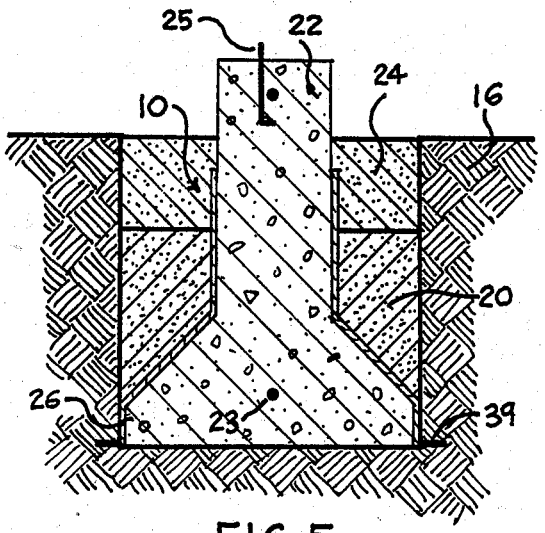
FIG. 5 is a vertical cross section view of an alternate shape of foundation system footing described in FIG. 4 that utilizes a thickened footing edge and additional anchor feet.

FIG. 5 describes essentially the same configuration of foundation system as FIG. 4, except that a thickened bottom footing edge 26 is depicted, which may be required in certain building code jurisdictions, and the small form anchor feet 39 are indicated, which may be used if necessary to improve form stability and bouyancy resistance.

The preferred embodiment of the formwork is depicted in FIGS. 6 through 10. Although many different form materials may be utilized to manufacture these forms, the preferred material is a laminated product using plies of paper, wood or fiber, similar in nature to rigid cardboard type products. Additionally, the inside and outside surfaces of this formwork are coated with or impregnated with a moisture resistant substance, such as paraffin or plastic, to form a suitable vapor barrier in the formwork and provide a chemical bond break with the concrete for ease of removal.

Figure 6:
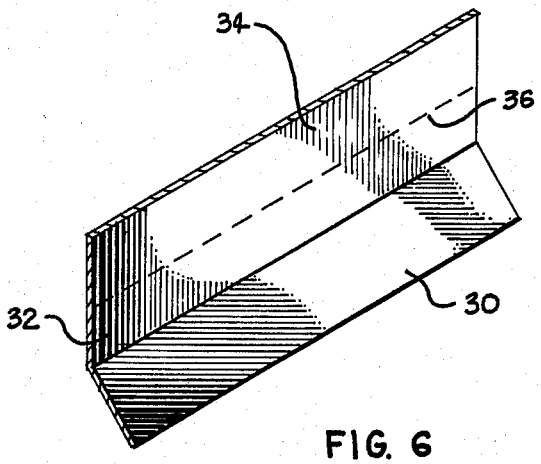
FIG. 6 is a perspective view of a straight section side member of the foundation system forms according to the present invention.
Figure 7:
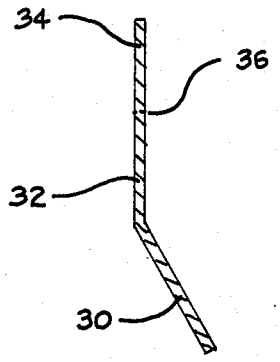
FIG. 7 is a side elevational cross sectional view of a straight section side member of the foundation system forms according to the present invention.
Figure 8:
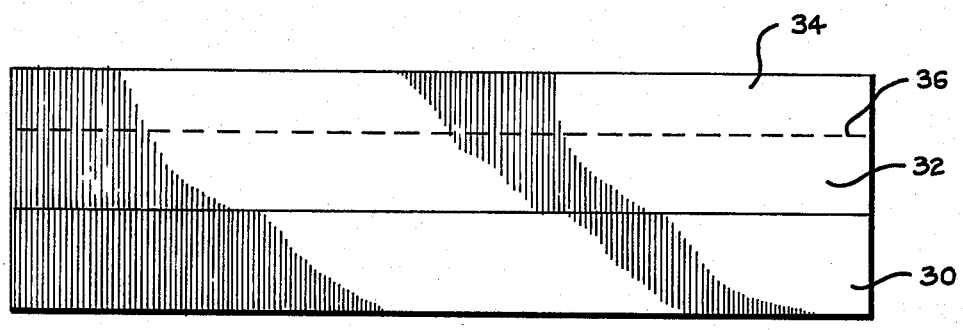
FIG. 8 is a front elevational view of a straight section side member of the foundation system forms according to the present invention.

Referring to FIGS. 6 through 8, the straight wall side panel forms are described by perspective view, side elevation view, and front elevation view, respectively. The forms are composed of four individual elements: the top wall portion 34 which is subsequently removed from the finished foundation assembly, the lower wall portion 32 which remains permanently in place, the inclined footing portion 30 which also remains permanently in place, and the perforated or weakened strip 36 which is the separation point between elements 32 and 34. The inclined portion 30 may be inclined at any angle from a horizontal line depending on the specified footing width and the required foundation depth, the most common and structurally efficient inclination being 60 degrees from horizontal.

Figure 9:
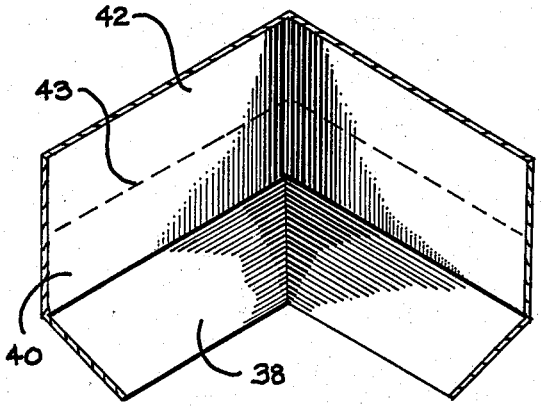
FIG. 9 is a perspective view of an inside corner section side member of the foundation system forms according to the present invention.

FIG. 9 depicts a perspective view of the prefabricated inside corner section side form, composed of the top wall portion 42, which is subsequently removed, the wall lower portion 40 which remains permanently in place, the weakened strip 43 and the lower inclined footing portion 38 which remains permanently in place. The corner section shown in manufactured for a 90 degree corner, however, any corner angle can be accommodated.

Figure 10:
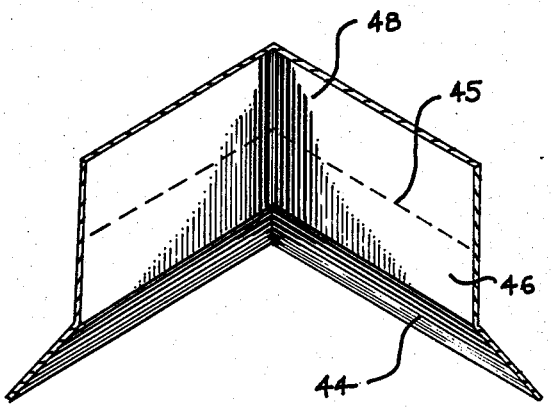
FIG. 10 is a perspective view of an outside corner section side member of the foundation system forms according to the present invention.

FIG. 10 similarly depicts a perspective view of the outside corner section side form, composed of wall top and bottom portions 48 and 46, weakened strip 45, and footing inclined portion 44.

Figure 11:
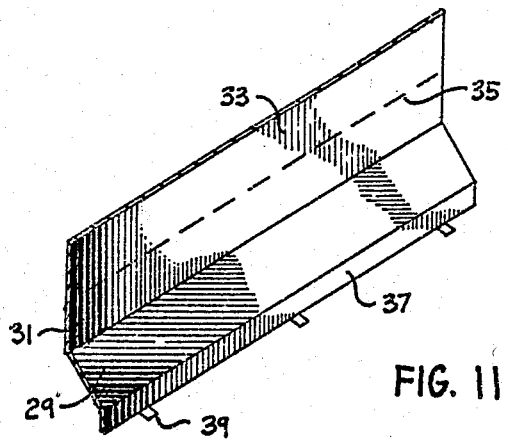
FIG. 11 is a perspective view of an alternate straight section side member of the foundation system forms according to the present invention.
Figure 12:
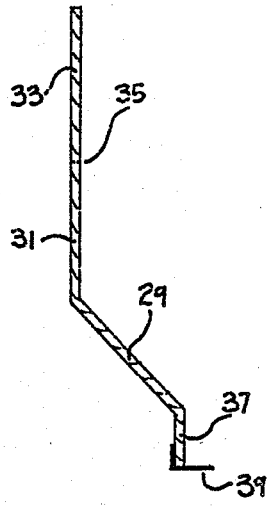
FIG. 12 is a side elevational cross sectional view of an alternate straight section side member of the foundation system forms according to the present invention.

FIGS. 11 and 12 are similar to FIGS. 6 and 7, except that they describe an alternate embodiment of the straight wall side panel. These forms are composed of six individual elements: the top wall portion 33 which is subsequently removed, the lower wall portion 31 which remains permanently in place, the weakened strip 35, the inclined footing portion 29 which remains permanently in place, the thickened edge section 37 also remaining permanently in place, and attachment feet 39 spaced as required to provide additional uplift resistance.

Figure 13:
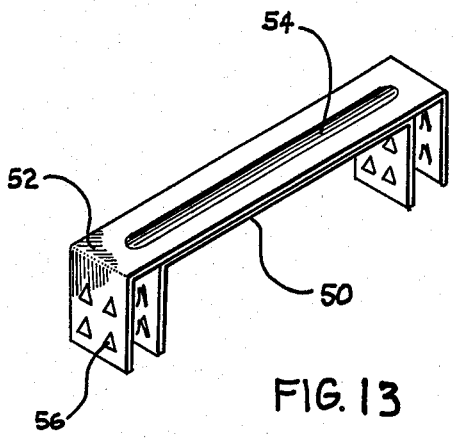
FIG. 13 is a perspective view of the top tie means of the foundation system according to the present invention.
Figure 14:
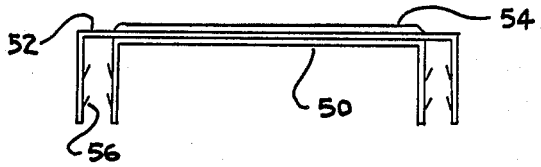
FIG. 14 is a side elevational view of the top tie means of the foundation system according to the present invention.

FIGS. 13 and 14 more thoroughly describe a top tie 12 used in the foundation system description of FIGS. 1 through 5. The tie consists of two separate generally U-shaped members, an inner member 50 and an outer member 52, attached or joined together in a manner so as to render the combination capable of functioning as one member. The lengths of the members are such that member 50 fits into and underneath member 54 leaving a small gap the width of the form thickness at each end. This attachment may be mechanical, such as riveting or welding, or chemical, such as with the use of special adhesives. Embossed in either 50 or 52, or both, is an optional deformed, reinforcement groove 54 that acts to strengthen and stabilize the tie laterally. Attachment/-connection teeth 56 are utilized at the vertical ends of the U-shaped members to grip and hold the top of the forms to which they are attached. Although this tie may be manufactured of any suitable material, the preferred embodiment is of light gauge sheet metal, and the clips 56 are actually triangular shaped teeth punched into the sheet metal surfaces utilizing common sheet metal fabricating processes. The teeth point toward the reinforcement strip 54 as depicted in FIG. 14, so as to engage and grab the top of the wall forms, and resist any tendency to slip off of forms 10.

Figure 15:
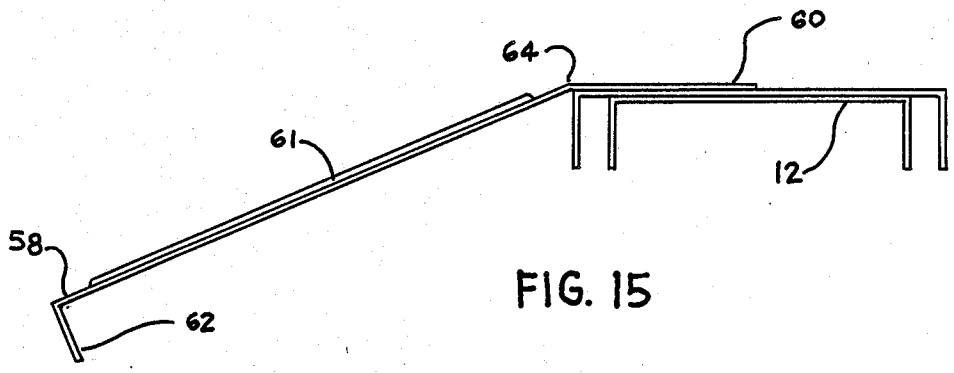
FIG. 15 is a side elevational view of the ground brace means operably coupled to the top tie means according to the present invention.
Figure 16:
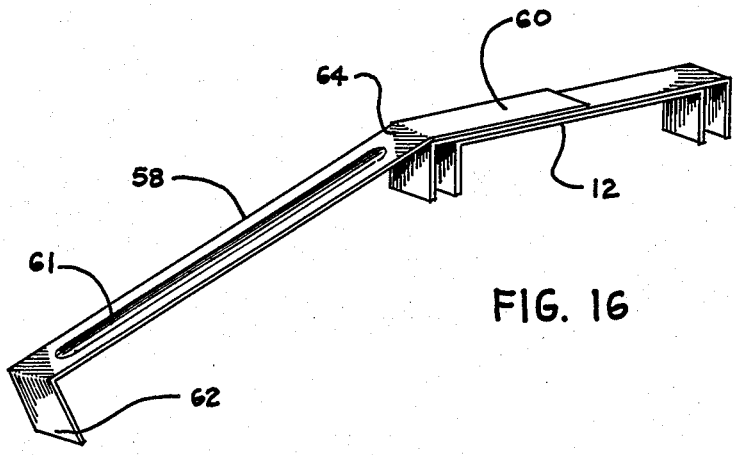
FIG. 16 is a perspective view of the ground brace means operably coupled to the top tie means according to the present invention.

FIGS. 15 and 16 depict the ground brace attachment 58 to the top tie 12 through the use of attachment means 60, which is sufficiently connected to the top tie 12 so as not to disengage during concrete placement. Again, this attachment may be either mechanical or chemical. A reinforcement strip 61 is also depicted. The lower end of said brace is manually driven into the ground adjacent to the forms to provide horizontal support through the flat surface element 62 bearing against the soil. The elbow joint 64 flexes to allow arm 58 to freely rotate during engagement of 62 into the ground.

Figure 17:
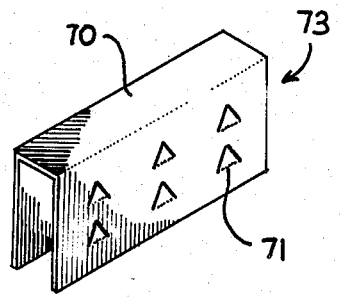
FIG. 17 is a perspective view of the top connection clip retention means according to the present invention.
Figure 18:
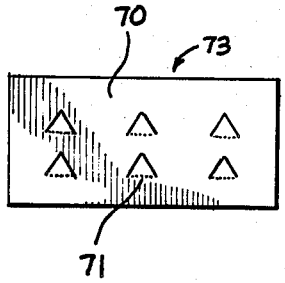
FIG. 18 is a front elevational view of the top connection clip retention means according to the present invention.
Figure 19:
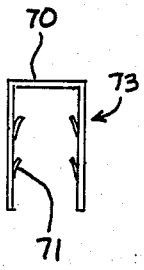
FIG. 19 is a side elevational cross sectional view of the top connection clip retention means according to the present invention.

FIGS. 17 through 19 depict the form top connection clip 73 used to connect the forms' horizontal coplanar panels 11 and 13 in end to end fashion. The connectors are manufactured of the same material as top tie 12, are a single piece, and are composed of clip 70 and connection teeth 71.

Figure 20:
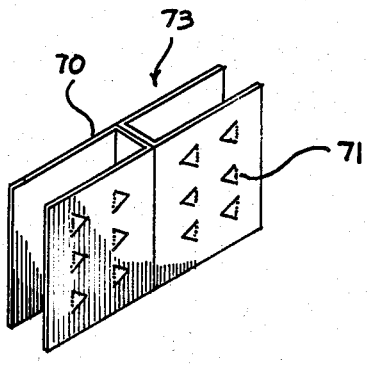
FIG. 20 is a perspective view of the side connection clip retention means according to the present invention.
Figure 21:
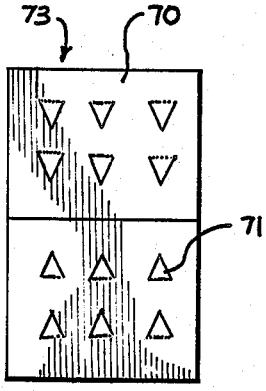
FIG. 21 is a front elevational view of the side connection clip retention means according to the present invention.
Figure 22:
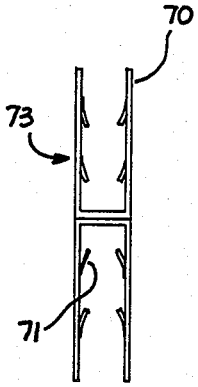
FIG. 22 is a side elevational cross sectional view of the side connection clip retention means according to the present invention.

FIGS. 20 through 22 depict the form midheight connection clips, composed of two top connection clips 73 attached back to back by mechanical or chemical means. These connection clips are also used to connect the forms' horizontal coplanar panels 11 and 13 in end to end fashion.

Figure 23:
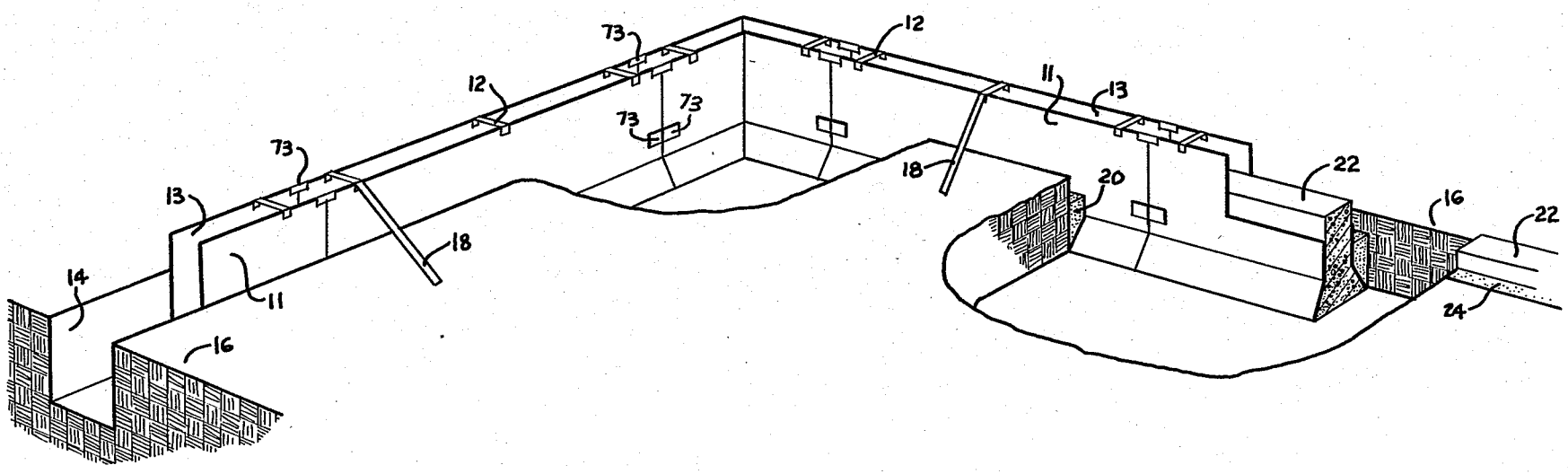
FIG. 23 is an overall perspective view of the foundation system assembly in various stages of construction.

FIG. 23 more thoroughly describes in perspective view the relationship among all the various components of the disclosed foundation system in various stages of construction.

While a complete disclosure of one form of the invention has been described with reference to the preferred embodiments thereof, it will be understood by those skilled in the art that the invention is not limited to the detail, terms and expressions of the embodiment disclosed. Furthermore, since numerous modifications and variations of the disclosed embodiment will be readily apparent to those skilled in the art, there is no intention, in the foregoing descriptions, of excluding equivalents of the features shown and described.

What is claimed is:

1. A monolithic building foundation system, comprising:

a plurality of horizontally elongated vertically planar members each having an upper planar portion and lower angled portion thereof, wherein each of said upper planar portions of each of said plurality of elongated vertically planar members further comprises an upper wall portion and a lower wall portion having weakened strip means disposed therebetween for separating said upper wall portion from said lower wall portion;

top tie means for removably coupling a pair of said plurality of horizontally elongated vertically planar members in a generally parallel relationship with respect to the upper planar portion, wherein the lower angled portions of each member of the pair diverge from each other; and connection means for coupling each pair of said plurality of horizontally elongated vertically planar members in a generally end-to-end fashion thereby forming a unitary longitudinal chamber.

2. The monolithic building foundation system according to claim 1, wherein each of said plurality of horizontally elongated vertically planar members further comprises any suitable laminated material.

3. The monolithic building foundation system according to claim 2, wherein each of said plurality of horizontally elongated vertically planar members further comprises a plied material selected from the group consisting of paper, wood, fiber or fiber composites, and plastic.

4. The monolithic building foundation system according to claim 1, wherein each of said plurality of horizontally elongated vertically planar members further comprises an outer covering of a moisture resistent release substance along the entire surface thereof.

5. The monolithic building foundation system according to claim 4, wherein said moisture resistant release substance is selected from the group consisting of paraffin, oil and plastic.

6. The monolithic building foundation system according to claim 1, wherein said top tie means further comprises an inner generally U-shaped member having a web and two legs and an outer generally U-shaped member having a web and two legs secured thereto, said top tie means further comprising a slot defined by the legs of said inner and said outer generally U-shaped members of sufficient size to operably engage a top edge portion of said upper planar portion of said horizontally elongated vertically planar member.

7. The monolithic building foundation system according to claim 6, wherein each of said inner and outer generally U-shaped members further comprise retention means integrally disposed on each leg of each of said inner and said outer generally U-shaped members for securely coupling said top tie means to said top edge portion of said upper planar portion of said plurality of elongated vertically planar members.

8. The monolithic building foundation system according to claim 7, wherein said retention means further comprises a plurality of pointed teeth protruding inwardly from the inner surface of each of said plurality of generally U-shaped members.

9. The monolithic building foundation system according to claim 1, wherein said connection means further comprises a plurality of general U-shaped members each having at least one slot of sufficient size to engage at least one of said plurality of elongated vertically planar members.

10. The monolithic building foundation system according to claim 9 wherein two of said plurality of generally U-shaped members are integrally attached in a symmetrical fashion.

11. The monolithic building foundation system according to claim 9, wherein each of said plurality of generally U-shaped members further comprise retention means integrally disposed on each of said plurality of generally U-shaped members for securely coupling said generally U-shaped members to said at least one of said plurality of elongated vertically planar members.

12. The monolithic building foundation system according to claim 11, wherein said retention means further comprises a plurality of pointed teeth protruding inwardly from the inner surface of each of said plurality of generally U-shaped members.

13. The monolithic building foundation system according to claim 12, wherein each of said lower angled portions of each of said plurality of elongated vertically planar members further comprises a footing portion inclined at any angle from the vertical plane of each of said plurality of elongated vertically planar members suitable to provide a footing for the monolithic building foundation system.

14. The monolithic building foundation system according to claim 13, wherein said footing portion further comprises an angled upper portion and a generally vertical planar lower portion thereof.

15. The monolithic building foundation system according to claim 13, wherein said footing portion is inclined at about a 60 degree angle from the vertical plane of each of said plurality of elongated vertically members of said upper generally planar portion of said plurality of elongated vertically planar members.

16. The monolithic building foundation system according to claim 13, wherein each of said plurality of horizontally elongated vertically planar members further comprises any suitable laminated material.

17. The monolithic building foundation system according to claim 16, wherein each of said plurality of horizontally elongated vertically planar members further comprises a plied material selected from the group consisting of paper, wood, fiber or fiber composites, and plastic.

18. The monolithic building foundation system according to claim 1, wherein at least one of said plurality of horizontally elongated vertically planar members further comprises corner member means for providing a foundation corner.

19. The monolithic building foundation system according to claim 18, wherein said corner member means further comprises two pairs of parallel elongated vertically planar members disposed in such a manner as to form an angle.

20. The monolithic building foundation system according to claim 19, wherein each of said plurality of horizontally elongated vertically planar members further comprises any suitable laminated material.

21. The monolithic building foundation system according to claim 20, wherein each of said plurality of horizontally elongated vertically planar members further comprises a plied material selected from the group consisting of paper, wood, fiber or fiber composites, and plastic.

22. The monolithic building foundation system according to claim 19, wherein each of said lower angled portions of each of said plurality of elongated vertically planar members further comprises a footing portion inclined at any angle from the vertical plane of said plurality of elongated vertically planar members suitable to provide a footing for the monolithic building foundation system.

23. The monolithic building foundation system according to claim 22, wherein said footing portion is inclined at about a 60 degree angle from the vertical plane of said upper planar portion of said plurality of elongated vertically planar members.

24. The monolithic building foundation system according to claim 23, wherein said footing portion further comprises an angled upper portion and a generally vertical planar lower portion thereof.

25. The monolithic building foundation system according to claim 23, wherein each of said plurality of horizontally elongated vertically planar members further comprises any suitable laminated material.

26. The monolithic building foundation system according to claim 25, wherein each of said plurality of horizontally elongated vertically planar members further comprises a plied material selected from the group consisting of paper, wood, fiber or fiber composites, and plastic.

27. The monolithic building foundation system according to claim 22, wherein each of said plurality of horizontally elongated vertically planar members further comprises any suitable laminated material.

28. The monolithic building foundation system according to claim 27, wherein each of said plurality of horizontally elongated vertically planar members further comprises a plied material selected from the group consisting of paper, wood, fiber or fiber composites, and plastic.

29. A method for constructing a monolithic building foundation comprising the steps of:

excavating earth to form a trench;

disposing within said trench a plurality of horizontally elongated vertically planar members each having an upper planar portion and a lower angled portion thereof wherein each of said upper planar portions further comprises an upper wall portion and a lower wall portion having weakened strip means disposed therebetween for separating said upper wall portion from said lower wall portion, in substantially parallel fashion such that each of said plurality of elongated vertically planar members corresponds and pairs with another of said plurality of elongated vertically planar members such that a continuous longitudinal chamber is formed therebetween;

supporting each of said corresponding horizontally elongated vertically planar members to each other in paired fashion;

bracing said paired and corresponding plurality of elongated vertically planar members to the adjacent earth;

pouring a predetermined amount of a generally plastic material into said continuous longitudinal chamber thereby forming therein a monolithic foundation footing and wall simultaneously;

removing a portion of said upper planar portion of each of said horizontally elongated vertically planar members after said plastic material hardens thereby leaving an upper foundation wall exposed; and backfilling around the monolithic building foundation system to a level grade.

30. The method for constructing a monolithic building foundation system according to claim 29, wherein said step of disposing a plurality of elongated vertically planar members further comprises the step of covering an inner surface of each of said plurality of elongated vertically planar members with a moisture resistent release substance along the entire surface thereof.

31. The method for constructing a monolithic building foundation system according to claim 30, wherein said moisture resistant release substance is selected from the group consisting of paraffin, oil and plastic.

32. The method for constructing a monolithic building foundation system according to claim 29, wherein said step of disposing a plurality of elongated vertically planar members within said trench further comprises providing a plurality of said elongated vertically planar members comprising any suitable laminated material.

33. The method for constructing a monolithic building foundation system according to claim 32, wherein each of said plurality of horizontally elongated vertically planar members further comprises a plied material selected from the group consisting of paper, wood, fiber or fiber composites, and plastic.

34. The method for constructing a monolithic building foundation system according to claim 29, wherein said step of supporting each of said corresponding elongated vertically oriented members by securing top tie means to an upper edge of each of said corresponding elongated vertically oriented members, said top tie means further comprising an inner generally U-shaped member having a web and two legs and an outer generally U-shaped member having a web and two legs secured thereto forming a slot defined by the legs of said inner and said outer generally U-shaped members of sufficient size to operably engage said upper edge of said horizontally elongated vertically planar member.

35. The method for constructing monolithic building foundation system according to claim 34, wherein each of said inner and outer generally U-shaped members further comprise retention means integrally disposed on each leg of each of said inner and said outer generally U-shaped members for securely coupling said top tie means to said upper edge of said horizontally elongated vertically planar member.

36. The method for constructing a monolithic building foundation system according to claim 35, wherein said retention means further comprises a plurality of generally pointed teeth protruding inwardly from the inner surfaces of each of said plurality of generally U-shaped members.

37. The method for constructing a monolithic building foundation system according to claim 29, wherein said step of disposing a plurality of elongated vertically planar members within said trench further comprises the step of providing a plurality of said elongated vertically planar members having said lower angled portions comprising a footing portion inclined at any angle from the vertical plane of said plurality of said elongated vertically planar members suitable to provide a footing for the monolithic building foundation system.

38. The method for constructing a monolithic building foundation system according to claim 37, wherein said footing portion is inclined at about a 60 degree angle from the vertical plane of said upper planar portion of said horizontally elongated vertically planar member.

39. The method for constructing a monolithic building foundation system according to claim 38, wherein said footing portion further comprises an angled upper portion and a generally vertical planar lower portion thereof.

* * * * *